US010029498B2

(12) United States Patent
Aoki

(10) Patent No.: US 10,029,498 B2
(45) Date of Patent: Jul. 24, 2018

(54) PRINTING APPARATUS WITH SEPARABLE HOUSINGS

(71) Applicant: RISO KAGAKU CORPORATION, Tokyo (JP)

(72) Inventor: Kazuyuki Aoki, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/585,257

(22) Filed: May 3, 2017

(65) Prior Publication Data

US 2017/0341442 A1 Nov. 30, 2017

(30) Foreign Application Priority Data

May 26, 2016 (JP) ..... 2016-105155

(51) Int. Cl.
*B41J 29/13* (2006.01)
*B41J 2/01* (2006.01)
*B41J 29/02* (2006.01)

(52) U.S. Cl.
CPC ..... *B41J 29/02* (2013.01); *B41J 29/13* (2013.01)

(58) Field of Classification Search
CPC . B41J 29/02; B41J 29/13; B41J 29/026; B41J 2/01
USPC ..... 347/101, 104, 108, 109
See application file for complete search history.

(56) References Cited

U.S. PATENT DOCUMENTS

| | | | | |
|---|---|---|---|---|
| 5,320,437 | A * | 6/1994 | Malke | B41J 3/36 400/208 |
| 5,355,160 | A | 10/1994 | Ozawa et al. | |
| 8,991,971 | B2 | 3/2015 | Suzuki et al. | |
| 2004/0213599 | A1 | 10/2004 | Huffman et al. | |
| 2012/0056960 | A1 | 3/2012 | Williams | |
| 2013/0088451 | A1 | 4/2013 | Payne et al. | |
| 2015/0145941 | A1* | 5/2015 | Gao | B41J 35/28 347/217 |

FOREIGN PATENT DOCUMENTS

| | | |
|---|---|---|
| EP | 0145311 | 6/1985 |
| EP | 1731275 | 12/2006 |
| JP | 2001-334725 | 12/2001 |
| WO | 2015/136915 | 9/2015 |

OTHER PUBLICATIONS

Extended European Search Report for EP 17171026.2 dated Oct. 11, 2017.

* cited by examiner

*Primary Examiner* — An Do
(74) *Attorney, Agent, or Firm* — Greenblum & Bernstein, P.L.C.

(57) ABSTRACT

A printing apparatus includes: a first component; a second component; a first housing configured to house the first component; a second housing configured to house the second component and movably supported on an installation surface on which the printing apparatus is installed; and a connector configured to connect the second housing openably and closably to the first housing in a horizontal direction and to allow a tilt of a turning axis of the second housing to the first housing and an upward and downward movement of the second housing to the first housing upon opening and closing of the second housing.

10 Claims, 8 Drawing Sheets

PRINTING APPARATUS WITH SEPARABLE HOUSINGS

CROSS REFERENCE TO RELATED APPLICATION

This application is based upon and claims the benefit of priority from the prior Japanese Patent Application No. 2016-105155, filed on May 26, 2016, the entire contents of which are incorporated herein by reference.

BACKGROUND

1. Technical Field

The disclosure relates to a printing apparatus including housings.

2. Related Art

In a printing apparatus in which components of the apparatus are housed in a housing, the components in the housing sometimes have to be accessed for maintenance. However, in the case of a large printing apparatus, in particular, a portion near the center of the apparatus is difficult to access because the portion is at a great distance from a door or the like of the housing.

To address this, the components arranged near the center of the apparatus may be thus limited to those which do not have to be accessed in maintenance. However, in this case, a space inside the housing cannot be effectively used and this leads to a size increase of the apparatus.

Moreover, when there are any components which have to be arranged near the center of the apparatus due to the apparatus configuration constraint and which have to be accessed in maintenance, other components have to be removed to access such components. As a result, efficiency of maintenance work is decreased.

In this regard, Japanese Unexamined Patent Application Publication No. 2001-334725 discloses a printing apparatus in which an electric component housing electric parts is arranged below a driver including a paper feed driver and the like and in which the electric component is configured to be openable and closeable relative to an apparatus main body. In this apparatus, size reduction of the apparatus is achieved by arranging the electric component below the driver. Moreover, maintenance work of the electric component is facilitated by making the electric component openable and closeable relative to the apparatus main body.

SUMMARY

In the apparatus disclosed in Japanese Unexamined Patent Application Publication No. 2001-334725, when the electric component is opened in the maintenance, troubles such as turnover of the apparatus due to decrease in the stability thereof and breakage of a connector between the apparatus main body and the electric component may occur depending on the weight of the electric component.

An object of the disclosure is to provide a printing apparatus which can improve efficiency of maintenance work while suppressing a size increase of the apparatus and suppressing breakage and decrease in stability of the apparatus in the maintenance work.

A printing apparatus in accordance with some embodiments includes: a first component; a second component; a first housing configured to house the first component; a second housing configured to house the second component and movably supported on an installation surface on which the printing apparatus is installed; and a connector configured to connect the second housing openably and closably to the first housing in a horizontal direction and to allow a tilt of a turning axis of the second housing to the first housing and an upward and downward movement of the second housing to the first housing upon opening and closing of the second housing.

In the configuration described above, since the second housing is openable and closable relative to the first housing, a worker can easily access a portion near an apparatus center in maintenance work. Hence, there is no need to limit components arranged near the apparatus center to components which do not have to be accessed in the maintenance. This enables effective usage of a space in the apparatus and can thus suppress a size increase of the apparatus. Moreover, since there is less need of work of removing components to access the components near the apparatus center, the efficiency of the maintenance work can be improved.

Furthermore, the second housing can be moved while being supported on the installation surface. The connector connects the second housing to the first housing such that the second housing is openable and closeable by moving in the horizontal direction, and allows the second housing to open and close relative to the first housing even while turning about a tilted turning axis, and even while moving upward and downward relative to the first housing. Accordingly, for example, when the turning axis of the second housing tilts or the second housing moves upward and downward due to unevenness of the installation surface, the second housing can be opened and closed while maintaining a state where the second housing is supported on the installation surface. This can suppress load applied to the connector and thus suppress breakage of the connector. Moreover, it is possible to suppress the case where the stability of the apparatus decreases due to change in weight balance caused by the opening of the second housing.

Accordingly, in the configuration described above, it is possible to improve the efficiency of the maintenance work while suppressing the size increase of the apparatus and suppressing the breakage and decrease in stability of the apparatus in the maintenance work.

The second housing may include divided housings. The printing apparatus may further include a divided housing connector configured to connect adjacent divided housings of the divided housings to each other openably and closably in the horizontal direction and to allow a tilt of a turning axis between the adjacent divided housings and a relative upward and downward movement between the adjacent divided housings upon opening and closing of the adjacent divided housings.

In the configuration described above, since the second housing is divided into the divided housings and the divided housings are openable and closeable, the inside of the second housing can be more easily accessed. The efficiency of the maintenance work can be thereby further improved.

The connector may include: a first shaft extending in an up-down direction and connected to one of the first housing and the second housing; and a first rod end bearing connected to the other of the first housing and the second housing. The divided housing connector may include: a second shaft extending in the up-down direction and connected to one of the adjacent divided housings; and a second rod end bearing connected to the other of the adjacent divided housings. The first rod end bearing may include a first spherical bearing having a first through hole in which the first shaft is inserted, the first spherical bearing being movable along the first shaft. The second rod bearing may include a second spherical bearing having a second through hole in which the second shaft is inserted, the second spherical bearing being movable along the second shaft.

In the configuration described above, the housings can be connected such that the housings are allowed to open and close even while turning about the tilted turning axis, and even while moving upward and downward, by using a simple configuration using general parts such as the rod end bearings.

The first component may include a printer configured to form an image on a print medium and the second component may include an electric component configured to drive the printer.

DETAILED DESCRIPTION

Figure 1:
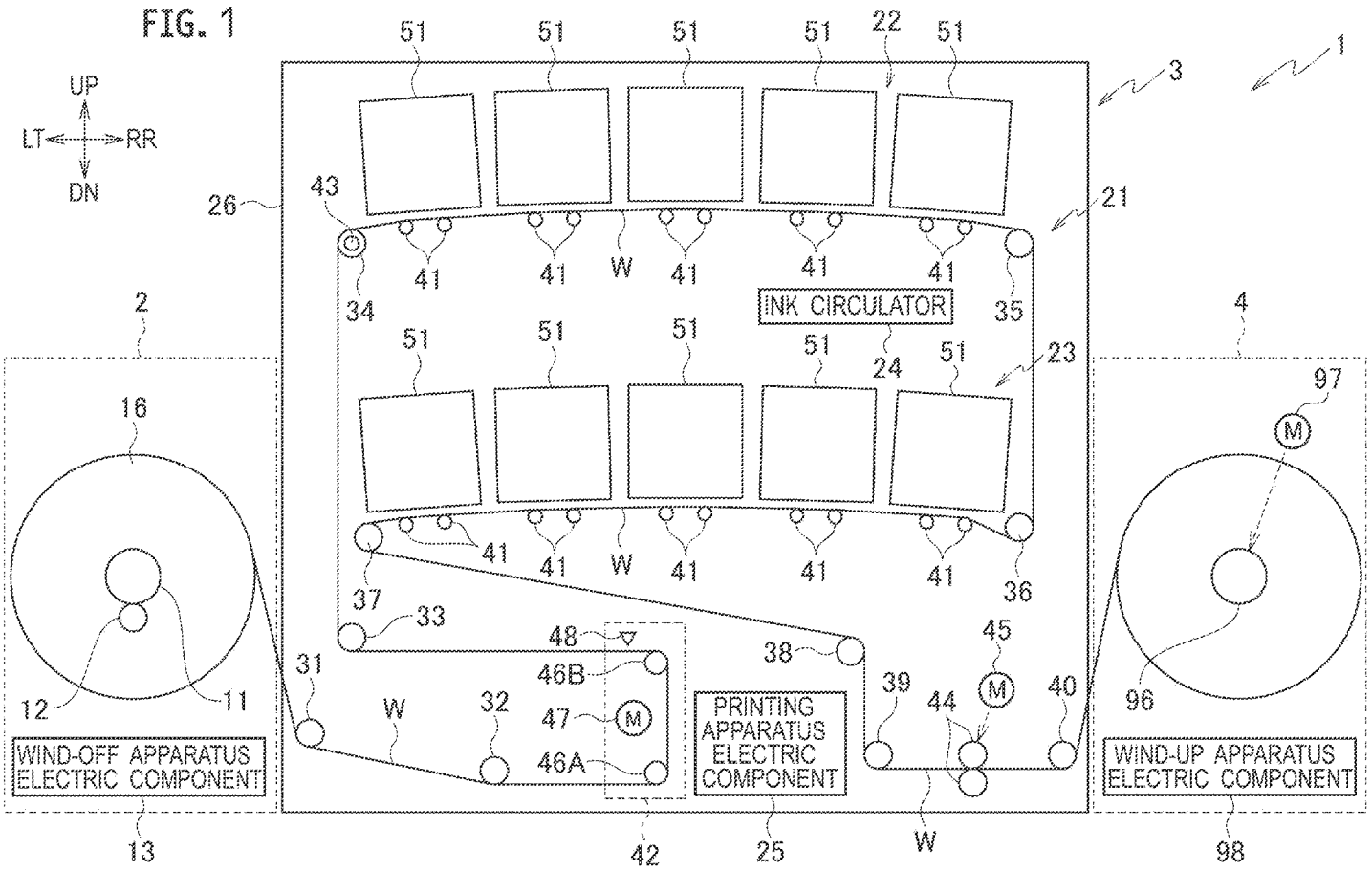
FIG. 1 is a schematic configuration diagram of a printing system in a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
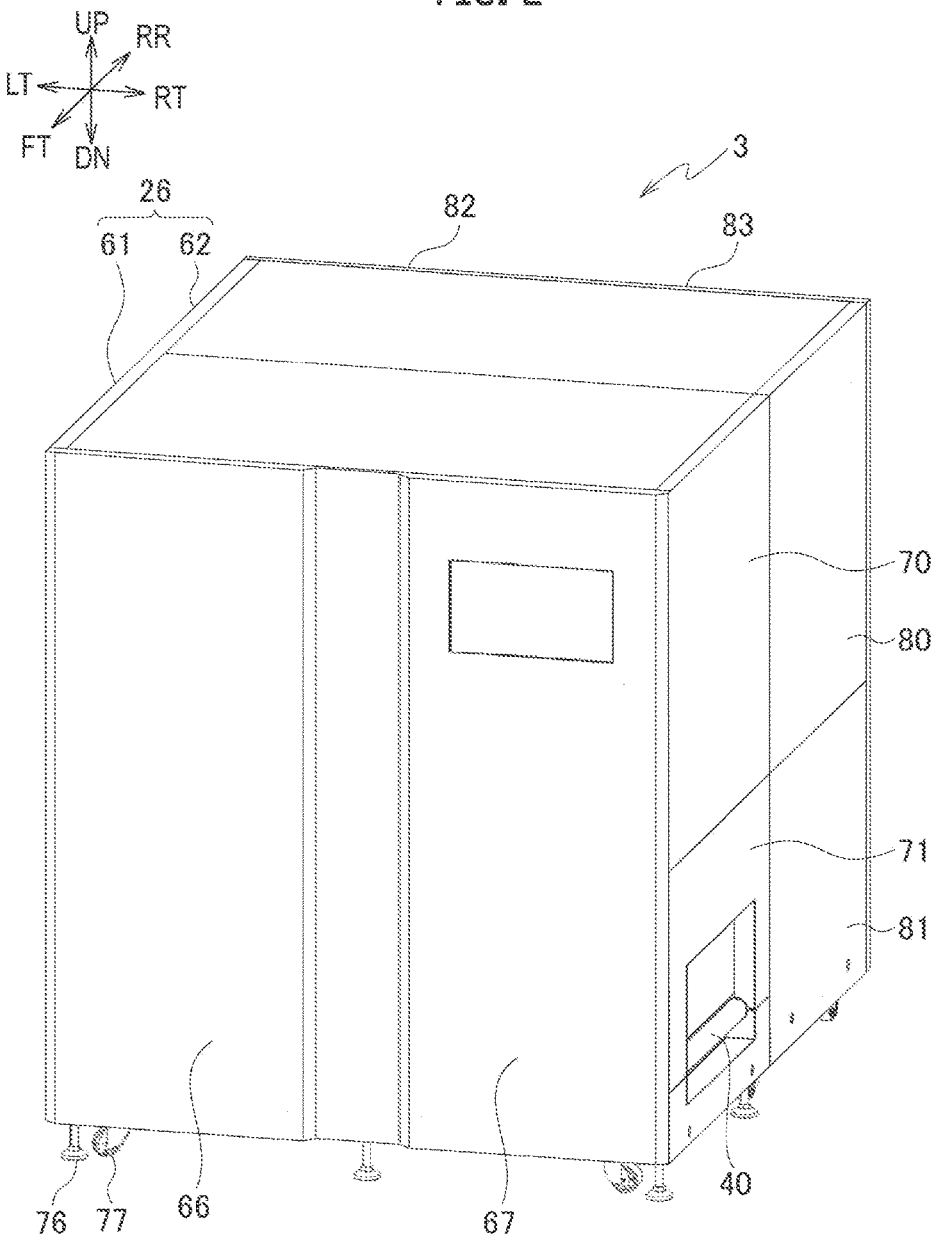
FIG. 2 is a front perspective view of a printing apparatus in the first embodiment.
Figure 3:
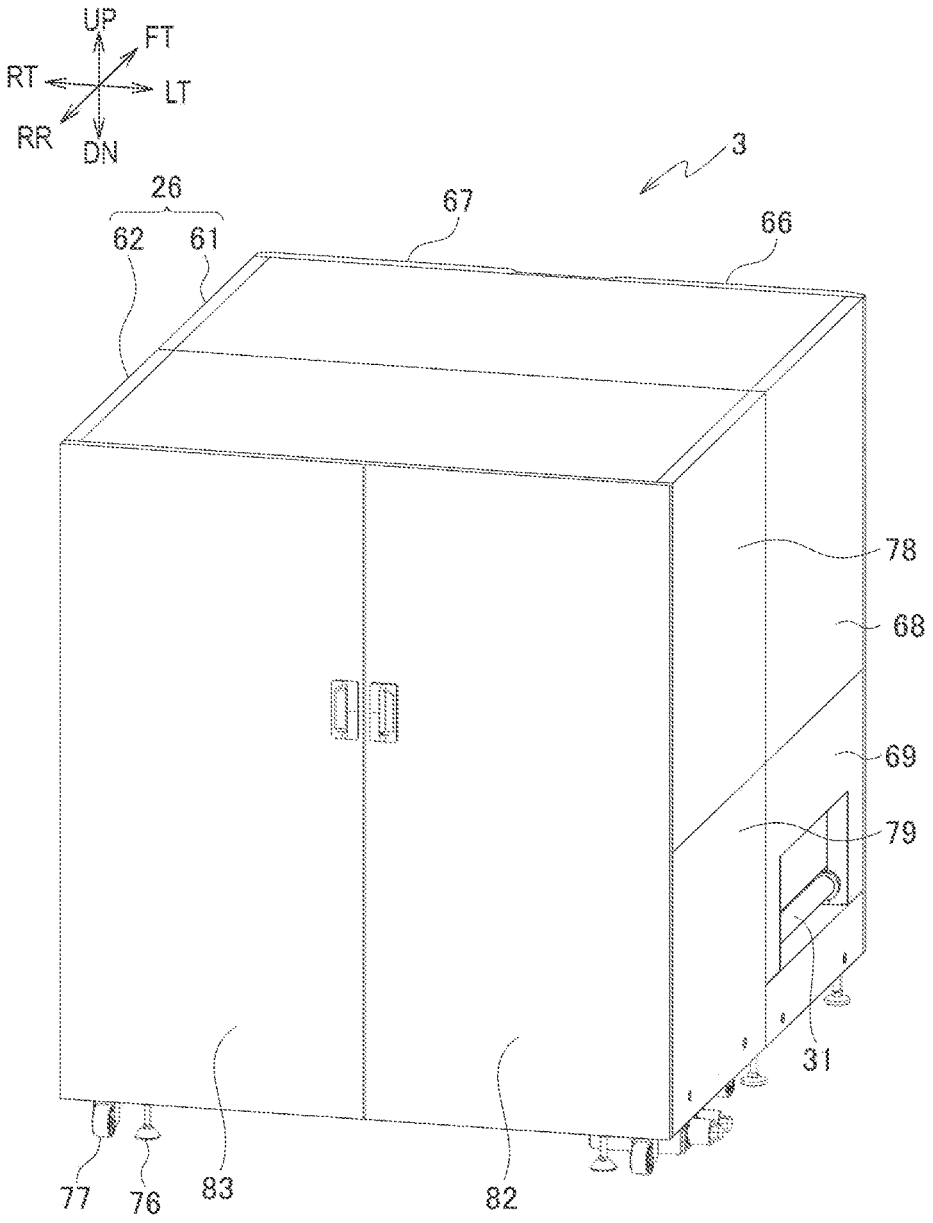
FIG. 3 is a rear perspective view of the printing apparatus illustrated in FIG. 2.
Figure 4:
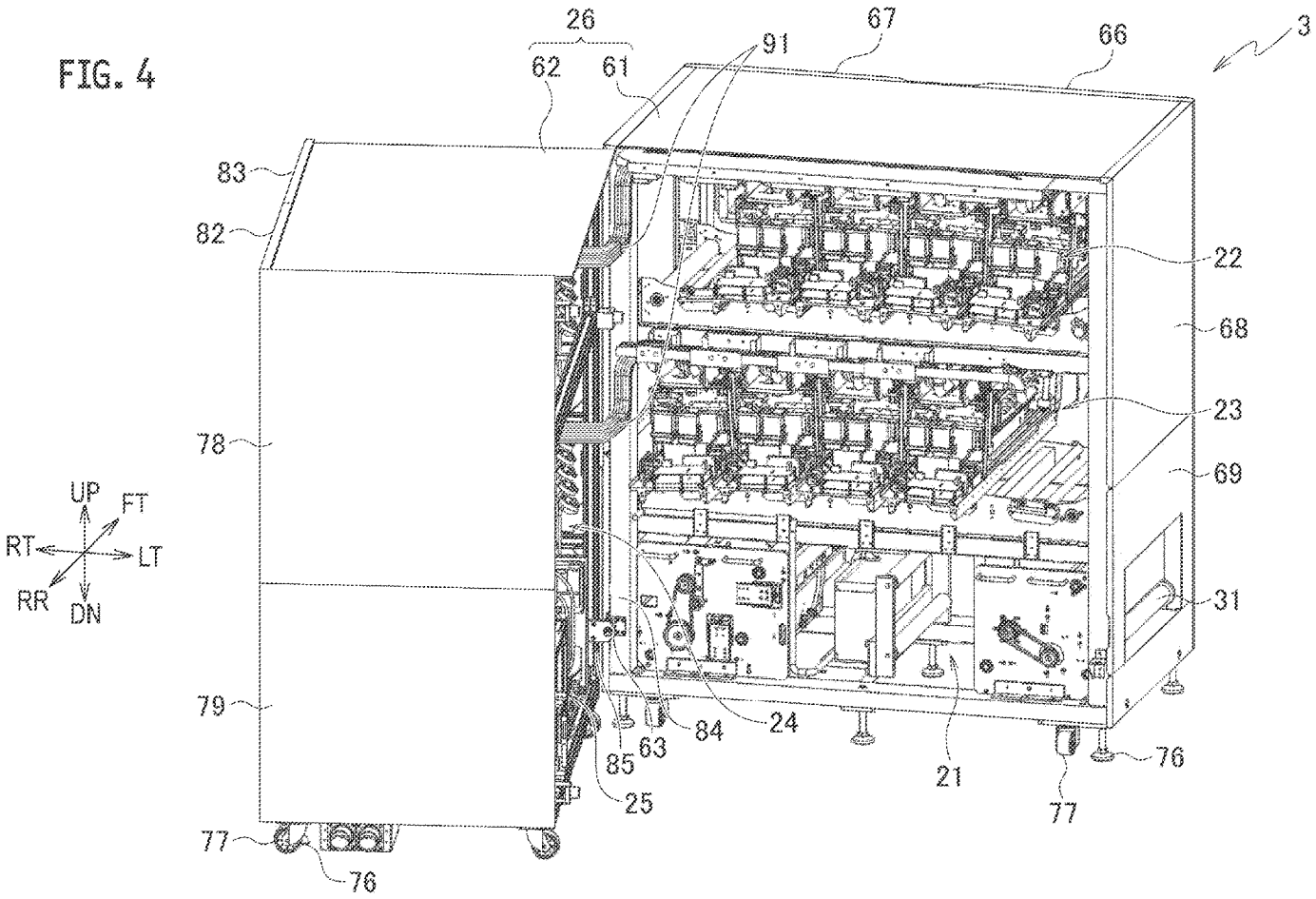
FIG. 4 is a perspective view of a state where an electric component housing of the printing apparatus illustrated in FIG. 2 is opened.
Figure 5:
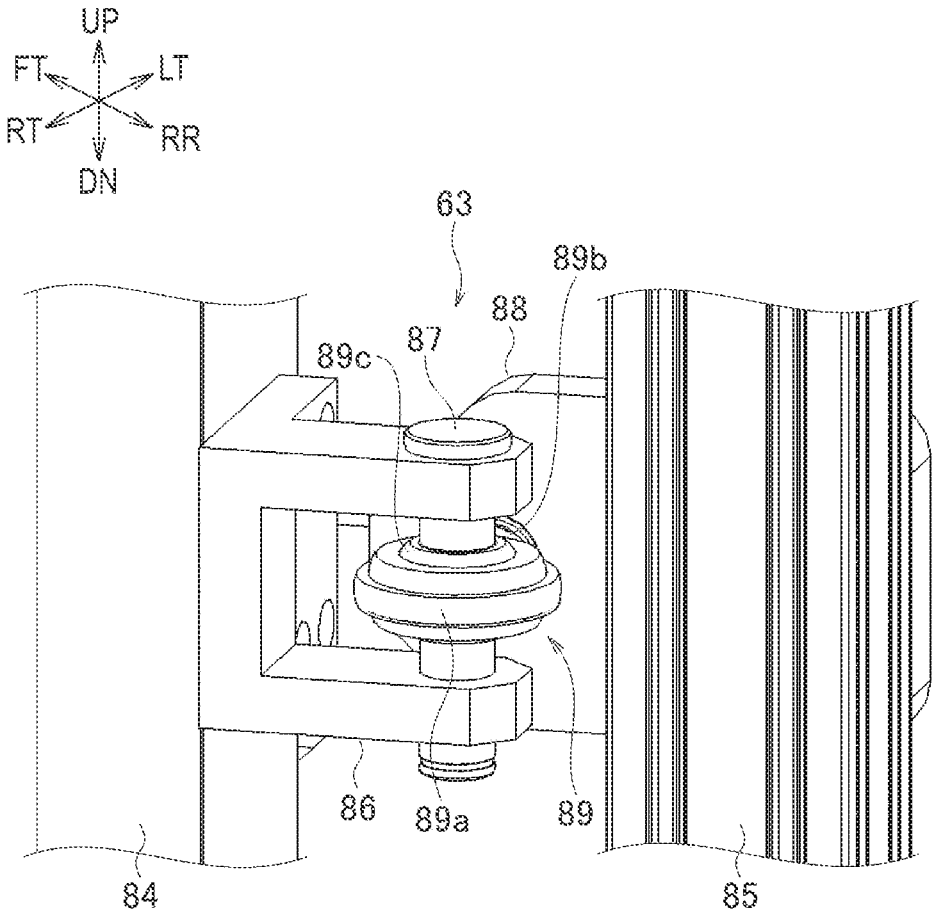
FIG. 5 is a perspective view of a connector in the printing apparatus illustrated in FIG. 2.

FIG. 1 is a schematic configuration diagram of a printing system 1 including a printing apparatus 3 in a first embodiment of the present invention. FIG. 2 is a front perspective view of the printing apparatus 3 of the printing system 1 illustrated in FIG. 1. FIG. 3 is a rear perspective view of the printing apparatus 3 illustrated in FIG. 2. FIG. 4 is a perspective view of a state where an electric component housing 62 of the printing apparatus 3 illustrated in FIG. 2 is opened. FIG. 5 is a perspective view of a connector 63 of the printing apparatus 3 illustrated in FIG. 2. Note that, in FIGS. 1 and 5 and FIGS. 6 to 8 to be described later, right, left, up, down, front, and rear are denoted by RT, LT, UP, DN, FT, and RR, respectively.

As illustrated in FIG. 1, the printing system 1 includes a wind-off apparatus 2, the printing apparatus 3, and a wind-up apparatus 4.

The wind-off apparatus 2 winds off a web W being a long print medium made of film, paper, or the like to the printing apparatus 3. The wind-off apparatus 2 includes a web roll support shaft 11, a brake 12, and a wind-off apparatus electric component 13.

The web roll support shaft 11 rotatably supports a web roll 16. The web roll support shaft 11 is formed in a long shape extending in a front-rear direction. The web roll 16 is a roll of the web W.

The brake 12 applies brake to the web roll support shaft 11. Tension is thereby applied to the web W between the web roll 16 and a pair of conveyance rollers 44 of the printing apparatus 3 to be described later.

The wind-off apparatus electric component 13 drives and controls the wind-off apparatus 2. The wind-off apparatus electric component 13 includes a control unit (not illustrated) configured to control the brake 12. The wind-off apparatus electric component 13 includes a power supply unit (not illustrated) configured to supply electric power to drive the wind-off apparatus 2.

The printing apparatus 3 prints images on the web W wound off from the wind-off apparatus 2 while conveying the web W. The printing apparatus 3 includes a conveyor 21, a first printer (printer) 22, a second printer (printer) 23, an ink circulator 24, a printing apparatus electric component (electric component) 25, and a housing 26.

The conveyor 21 conveys the web W wound off from the wind-off apparatus 2. The conveyor 21 includes guide rollers 31 to 40, twenty under-head support members 41, a meandering corrector 42, an encoder 43, the pair of conveyance rollers 44, and a conveyance motor 45.

The guide rollers 31 to 40 guide the web W conveyed in the printing apparatus 3. The guide rollers 31 to 40 rotate by following the conveyed web W. The guide rollers 31 to 40 are formed in a long shape extending in the front-rear direction.

The guide rollers 31 and 32 guide the web W between the wind-off apparatus 2 and the meandering corrector 42. The guide roller 31 is arranged near a left face of the housing 26 in a lower portion of the printing apparatus 3. The guide roller 32 is arranged between the guide roller 31 and a meandering correction roller 46A of the meandering corrector 42 to be described later.

The guide rollers 33 to 39 guide the web W between the meandering corrector 42 and the pair of conveyance rollers 44. The guide roller 33 is arranged on the left of a meandering correction roller 46B of the meandering corrector 42 to be described later. The guide roller 34 is arranged above the guide roller 33. The guide roller 35 is arranged on the right of the guide roller 34 at the same height as the guide roller 34. The guide roller 36 is arranged below the guide roller 35 and above the guide roller 33. The guide roller 37 is arranged on the left of the guide roller 36, near and on the right of the web W between the guide rollers 33 and 34, at substantially the same height as the guide roller 36. The guide roller 38 is arranged on the lower right side of the guide roller 37. The guide roller 39 is arranged below and slightly on the right of the guide roller 38.

The guide roller 40 guides the web W between the pair of conveyance rollers 44 and the wind-up apparatus 4. The guide roller 40 is arranged near a right face of the housing 26 in the lower portion of the printing apparatus 3.

The under-head support members 41 support the web W under the first printer 22 and the second printer 23. The under-head support members 41 are formed in a long shape extending in the front-rear direction. Ten under-head support members 41 are arranged in each of an area between the guide rollers 34 and 35 which is under the first printer 22 and an area between the guide rollers 36 and 37 which is under the second printer 23.

The ten under-head support members 41 in each of the area between the guide rollers 34 and 35 and the area between the guide rollers 36 and 37 are arranged in an arch shape protruding upward. The web W is thereby tensioned and maintained in a stable position between the guide rollers 34 and 35 and between the guide rollers 36 and 37.

The meandering corrector 42 corrects meandering of the web W. The meandering corrector 42 includes the meandering correction rollers 46A and 46B, a meandering correction motor 47, and a web sensor 48.

The meandering correction rollers 46A and 46B are rollers for guiding the web W and correcting the meandering of the web W. The meandering correction rollers 46A and 46B are formed in a long shape extending in the front-rear direction. The meandering correction rollers 46A and 46B are each configured such that the angle of the axial direction of the meandering correction roller to the front-rear direction on a horizontal plane can be adjusted. The meandering correction roller 46A is arranged on the right of the guide roller 32. The meandering correction roller 46B is arranged above the meandering correction roller 46A.

The meandering correction motor 47 turns the meandering correction rollers 46A and 46B about an axis orthogonal to the horizontal plane to adjust the angles of axial directions of the meandering correction rollers 46A and 46B to the front-rear direction on the horizontal plane.

The web sensor 48 detects the positions of edges of the web W in the front-rear direction to correct the meandering. The web sensor 48 is arranged near the meandering correction roller 46B.

The encoder 43 is connected to the guide roller 34 and outputs a pulse signal every time the guide roller 34 rotates by a predetermined angle. The pulse signal outputted from the encoder 43 is used to control conveyance speed of the web W.

The pair of conveyance rollers 44 convey the web W toward the wind-up apparatus 4 while nipping the web W. The pair of conveyance rollers 44 are arranged between the guide rollers 39 and 40.

The conveyance motor 45 rotationally drives the conveyance rollers 44.

The first printer 22 prints images on a front side of the web W. The first printer 22 is arranged above the web W between the guide rollers 34 and 35. The first printer 22 includes five head units 51.

The head units 51 include inkjet heads (not illustrated) and eject inks from nozzles of the inkjet heads. The five head units 51 of the first printer 22 eject inks of different colors, respectively.

The second printer 23 prints images on a back side of the web W. The second printer 23 is arranged above the web W between the guide rollers 36 and 37. The second printer 23 includes five head units 51 configured to eject inks of different colors, respectively, like the first printer 22.

The ink circulator 24 supplies the inks to the inkjet heads of the head units 51 while circulating the inks along ink circulation routes (not illustrated). The ink circulator 24 includes the ink circulation route, an ink cartridge (not illustrated) configured to supply the ink to the ink circulation route, and the like for each of the head units 51.

The printing apparatus electric component 25 drives and controls the units of the printing apparatus 3. The printing apparatus electric component 25 includes a head drive control unit configured to control the inkjet heads of the head units 51 and a conveyance control unit configured to control conveyance of the web W by the conveyor 21 (both units are not illustrated). The printing apparatus electric component 25 includes a meandering control unit configured to control the meandering corrector 42 and an ink circulation control unit configured to control the ink circulator 24 (both units are not illustrated). The printing apparatus electric component 25 includes a power supply unit (not illustrated) configured to supply electric power to drive the printing apparatus 3.

The housing 26 houses the conveyor 21, the first printer 22, the second printer 23, the ink circulator 24, and the printing apparatus electric component 25. As illustrated in FIGS. 2 to 4, the housing 26 includes a main body housing (first housing) 61, an electric component housing (second housing) 62, the connector 63, and a lock unit 64.

The main body housing 61 houses the conveyor 21, the first printer 22, and the second printer 23 which are some of the multiple components of the printing apparatus 3. The main body housing 61 is formed in a hollow rectangular solid shape. A front face of the main body housing 61 is configured to be openable and closeable by front doors 66 and 67. A left face of the main body housing 61 is formed of side covers 68 and 69 detachably attached. A right face of the main body housing 61 is formed of side covers 70 and 71 detachably attached. A rear side of the main body housing 61 is open.

Multiple adjusters 76 and casters 77 are attached to a bottom face of the main body housing 61. The adjusters 76 adjust the position of the main body housing 61 such that the bottom surface of the main body housing 61 is horizontal, and fix the main body housing 61 to an installation surface on which the printing apparatus 3 is installed. The casters 77 support the main body housing 61 such that the main body housing 61 is movable on the installation surface.

The electric component housing 62 houses the ink circulator 24 and the printing apparatus electric component 25 which are components other than some of the multiple components of the printing apparatus 3 housed in the main body housing 61. The electric component housing 62 is formed in a hollow rectangular solid shape with the same height and width as the main body housing 61. The electric component housing 62 is open on the front side. A left face of the electric component housing 62 is formed of side covers 78 and 79 detachably attached. A right face of the electric component housing 62 is formed of side covers 80 and 81 detachably attached. A rear face of the electric component housing 62 is configured to be openable and closeable by rear doors 82 and 83. Note that the front-rear direction and the left-right direction of the electric component housing 62 are directions in the state where the electric component housing 62 is closed relative to the main body housing 61 as illustrated in FIGS. 2 and 3.

Multiple adjusters 76 and casters 77 which are the same as those attached to the bottom face of the main body housing 61 are attached to a bottom face of the electric component housing 62.

The connector 63 connects the main body housing 61 and the electric component housing 62 to each other. The connector 63 is installed across a vertical frame 84 arranged in a rear right corner of the main body housing 61 and a vertical frame 85 arranged in a front right corner of the electric component housing 62. The connector 63 thereby connects the main body housing 61 and the electric component housing 62 at right ends thereof. Note that, although the connector 63 connects the main body housing 61 and the electric component housing 62 at the right ends thereof in the embodiment, the connector 63 may connect the housings at left ends thereof.

As illustrated in FIG. 5, the connector 63 includes a hinge base 86, a hinge pin (shaft) 87, a rod end bearing support portion 88, and a rod end bearing 89.

The hinge base 86 is a member configured to hold the hinge pin 87. The hinge base 86 is fixed to the vertical frame 84 of the main body housing 61.

The hinge pin 87 is a member which is the center of turning in the case where the electric component housing 62 is opened and closed relative to (separated from) the main body housing 61. The hinge pin 87 has a long (elongated) columnar shape extending in an up-down direction. The hinge pin 87 is fixed to the hinge base 86 and is connected to the main body housing 61 via the hinge base 86.

The rod end bearing support portion 88 is a member supporting the rod end bearing 89. The rod end bearing support portion 88 is fixed to the vertical frame 85 of the electric component housing 62. An attachment hole is formed in the rod end bearing support portion 88, and a rod portion 89*b* of the rod end bearing 89 to be described later is screwed to the attachment hole.

The rod end bearing 89 is a member for connecting the electric component housing 62 to the main body housing 61 such that the electric component housing 62 is openable and closable (separable). The rod end bearing 89 is fixed to the rod end bearing support portion 88 and is connected to the electric component housing 62 via the rod end bearing support portion 88. The rod end bearing 89 includes a housing portion 89*a*, the rod portion 89*b*, and a ball portion (spherical bearing) 89*c*.

The housing portion 89*a* houses and supports the ball portion 89*c* in a movable manner. The rod portion 89*b* is a portion of a rod formed integrally with the housing portion 89*a*. Threads are formed on the rod portion 89*b*. The rod portion 89*b* is screwed to the attachment hole of the rod end bearing support portion 88. The ball portion 89*c* has a through hole and the hinge pin 87 is inserted in the through hole.

The housing portion 89*a* and the ball portion 89*c* have structures coming into contact on spherical surfaces. The ball portion 89*c* slides on the spherical surface of the housing portion 89*a*. The ball portion 89*c* can tilt relative to the housing portion 89*a*. Accordingly, the electric component housing 62 can be turned to be opened and closed relative to the main body housing 61, and the connector 63 allows the electric component housing 62 to turn about the turning axis tilted due to the unevenness of the installation surface.

The ball portion 89*c* is movable along the hinge pin 87. Accordingly, when the electric component housing 62 moves upward and downward due to the unevenness of the installation surface in the opening and closing of the electric component housing 62 relative to the main body housing 61, the connector 63 allows this upward and downward movement of the electric component housing 62.

As described above, the connector 63 is configured to connect the electric component housing 62 to the main body housing 61 such that the electric component housing 62 is openable and closeable by moving in the horizontal direction, and to allow the electric component housing 62 to open and close relative to the main body housing 61 even while turning about the tilted the turning axis, and even while moving upward and downward (moving upward and downward relative to the main body housing 61).

The lock unit 64 locks the electric component housing 62 such that the electric component housing 62 does not open when the electric component housing 62 is closed relative to the main body housing 61. The lock unit 64 is arranged at a left end of an opening portion on the front side of the electric component housing 62.

As illustrated in FIG. 4, in the housing 26, wires 91 connecting objects housed in the main body housing 61 and objects housed in the electric component housing 62 are laid along the face on the right side in the left-right direction which is the side where the connector 63 is installed, to extend across the main body housing 61 and the electric component housing 62. This can prevent the wires 91 from hindering the opening operation of the electric component housing 62. In this case, the wires 91 include wires electrically connecting the objects in the main body housing 61 and the objects in the electric component housing 62 and pipes forming the ink circulation routes of the ink circulator 24.

The wind-up apparatus 4 winds up the web W subjected to printing in the printing apparatus 3. The wind-up apparatus 4 includes a wind-up shaft 96, a wind-up motor 97, and a wind-up apparatus electric component 98.

The wind-up shaft 96 winds up and holds the web W. The wind-up shaft 96 is formed in a long shape extending in the front-rear direction.

The wind-up motor 97 rotates the wind-up shaft 96 clockwise in FIG. 1. The wind-up shaft 96 winds up the web W by being rotated.

The wind-up apparatus electric component 98 drives and controls the wind-up apparatus 4. The wind-up apparatus electric component 98 includes a control unit (not illustrated) configured to control the wind-up motor 97. The wind-up apparatus electric component 98 includes a power supply unit (not illustrated) configured to supply electric power to drive the wind-up apparatus 4.

Next, operations in printing by the printing system 1 are described.

When the printing is performed in the printing system 1, first, the wind-off apparatus 2, the printing apparatus 3, and the wind-up apparatus 4 start conveyance of the web W. Specifically, the control unit of the wind-off apparatus electric component 13 activates the brake 12, the conveyance control unit of the printing apparatus electric component 25 starts the drive of the conveyance motor 45, and the control unit of the wind-up apparatus electric component 98 starts the drive of the wind-up motor 97. This causes the web W to be conveyed from the wind-off apparatus 2 to the wind-up apparatus 4. Applying brake to the web roll support shaft 11 with the brake 12 of the wind-off apparatus 2 causes the web W to be conveyed with tension applied to the web W between the web roll 16 and the conveyance rollers 44.

Moreover, the ink circulation control unit of the printing apparatus electric component 25 starts an ink circulation operation by the ink circulator 24.

After the conveyance of the web W and the ink circulation operation are started, the head drive control unit of the printing apparatus electric component 25 controls the inkjet heads of the head units 51 in the first and second printers 22 and 23 to print images on the web W.

During the conveyance of the web W, the conveyance control unit of the printing apparatus electric component 25 calculates the conveyance speed of the web W based on the pulse signal outputted from the encoder 43. Then, the conveyance control unit controls the current to be supplied to the conveyance motor 45 such that the difference between the calculated conveyance speed and print conveyance speed (target speed) becomes zero. The conveyance speed of the web W is thereby controlled to be constant.

Moreover, the conveyance control unit of the printing apparatus electric component 25 calculates output torque of the conveyance motor 45 corresponding to the current supplied to the conveyance motor 45. The value of the output torque of the conveyance motor 45 corresponding to the supplied current can be calculated from motor characteristics of the conveyance motor 45. The control unit of the wind-off apparatus electric component 13 adjusts the brake force (output torque) of the brake 12 such that the difference between the output torque of the brake 12 and the output torque of the conveyance motor 45 calculated by the conveyance control unit of the printing apparatus electric component 25 becomes a target torque difference corresponding to target tension of the web W. The tension of the web W is thereby controlled to be constant.

When the printing of the images is completed, the ink circulation control unit of the printing apparatus electric component 25 terminates the ink circulation operation by the ink circulator 24. Moreover, the wind-off apparatus 2, the printing apparatus 3, and the wind-up apparatus 4 terminate the conveyance of the web W. Specifically, the control unit of the wind-off apparatus electric component 13 stops the brake 12, the conveyance control unit of the printing apparatus electric component 25 stops the conveyance motor 45, and the control unit of the wind-up apparatus electric component 98 stops the wind-up motor 97. The series of operations is thereby completed.

Next, description is given of operations of opening and closing the electric component housing 62 relative to the main body housing 61 in the printing apparatus 3.

The opening and closing of the electric component housing 62 relative to the main body housing 61 is performed in maintenance work of the printing apparatus 3, and is performed manually by a worker such as a service man.

When the electric component housing 62 is to be opened from a closed state relative to the main body housing 61, first, the worker unfixes the electric component housing 62 which is fixed to the installation surface by the adjusters 76. The electric component housing 62 is thereby set to be movably supported on the installation surface by the casters 77. In this case, the main body housing 61 is fixed to the installation surface by the adjusters 76.

Next, the worker unlocks the lock unit 64. Then, the worker pulls the left portion of the electric component housing 62 backward, and the electric component housing 62 is thus turned clockwise in a top view about the hinge pin 87 of the connector 63.

The electric component housing 62 is turned while being supported on the installation surface by the casters 77. When the electric component housing 62 tilts due to the unevenness of the installation surface in the turning and the turning axis of the electric component housing 62 thereby tilts, this tilting is allowed by the rod end bearing 89 of the connector 63. Accordingly, the state where the electric component housing 62 is supported on the installation surface by the casters 77 can be maintained. Moreover, when the electric component housing 62 moves up and down due to the unevenness of the installation surface, this upward and downward movement of the electric component housing 62 is allowed by the rod end bearing 89 of the connector 63 which moves upward and downward along the hinge pin 87. Accordingly, the state where the electric component housing 62 is supported on the installation surface by the casters 77 can be maintained.

In the state where the electric component housing 62 is turned and opened relative to the main body housing 61, as illustrated in FIG. 4, the worker can access the conveyor 21, the first printer 22, and the second printer 23 in the main body housing 61, from the opening portion on the rear side of the main body housing 61. Moreover, the worker can access the ink circulator 24 and the printing apparatus electric component 25 in the electric component housing 62 from the opening portion of the electric component housing 62. The worker can thereby access parts and the like near the center of the printing apparatus 3 which are difficult to access even when the front doors 66 and 67 and the rear doors 82 and 83 are opened and the side covers 68 to 71 and 78 to 81 are removed, and perform maintenance work of these parts and the like.

When the electric component housing 62 is to be closed relative to the main body housing 61, the worker manually turns the electric component housing 62 in the opposite direction to the opening direction. When the electric component housing 62 is closed, the worker operates the lock unit 64 and the electric component housing 62 is thereby locked in the closed state relative to the main body housing 61. Then, the worker adjusts the adjusters 76, and the electric component housing 62 is thereby fixed to the installation surface.

As described above, in the printing apparatus 3, since the electric component housing 62 is openable and closeable relative to the main body housing 61, the worker can easily access a portion near the apparatus center in the maintenance work. Hence, there is no need to limit objects arranged near the apparatus center to objects which do not have to be accessed in the maintenance. This enables effective usage of the space in the apparatus and can thus suppress the size increase of the apparatus. Moreover, since there is less need of work of removing objects to access the objects near the apparatus center, the efficiency of the maintenance work can be improved.

Furthermore, in the printing apparatus 3, the electric component housing 62 can be moved while being supported on the installation surface by the casters 77. The connector 63 connects the electric component housing 62 to the main body housing 61 such that the electric component housing 62 is openable and closeable by moving in the horizontal direction, and allows the electric component housing 62 to open and close relative to the main body housing 61 even while turning about the tilted turning axis, and even while moving upward and downward. Accordingly, when the turning axis of the electric component housing 62 tilts or the electric component housing 62 moves upward and downward due to the unevenness of the installation surface, the electric component housing 62 can be opened and closed while maintaining the state where the electric component housing 62 is supported on the installation surface by the casters 77. This can suppress load applied to the connector 63 and thus suppress breakage of the connector 63. Moreover, it is possible to suppress the case where the stability of the printing apparatus 3 decreases due to change in weight balance caused by the opening of the electric component housing 62.

Accordingly, in the printing apparatus 3, it is possible to improve the efficiency of the maintenance work while suppressing the size increase of the apparatus and suppressing the breakage and decrease in stability of the apparatus in the maintenance work.

Moreover, in the printing apparatus 3, since the housing 26 is divided into the main body housing 61 and the electric component housing 62, the accuracy and strength required for the housing can be reduced compared to those in an integral structure. Specifically, the main body housing 61 requires high accuracy and strength to hold the head units 51. Meanwhile, the electric component housing 62 may have lower accuracy and strength. Accordingly, manufacturing of the housing is facilitated.

Moreover, in the printing apparatus 3, the connector 63 includes the hinge pin 87 and the rod end bearing 89. In addition, the hinge pin 87 is inserted into the through hole in the ball portion 89*c* of the rod end bearing 89, and the ball portion 89*c* is movable along the hinge pin 87. Accordingly, the main body housing 61 and the electric component housing 62 can be connected to each other such that the electric component housing 62 is allowed to open and close even while turning about the tilted turning axis, and even while moving upward and downward, by using a simple configuration using general parts such as the rod end bearing.

Second Embodiment

Figure 6:
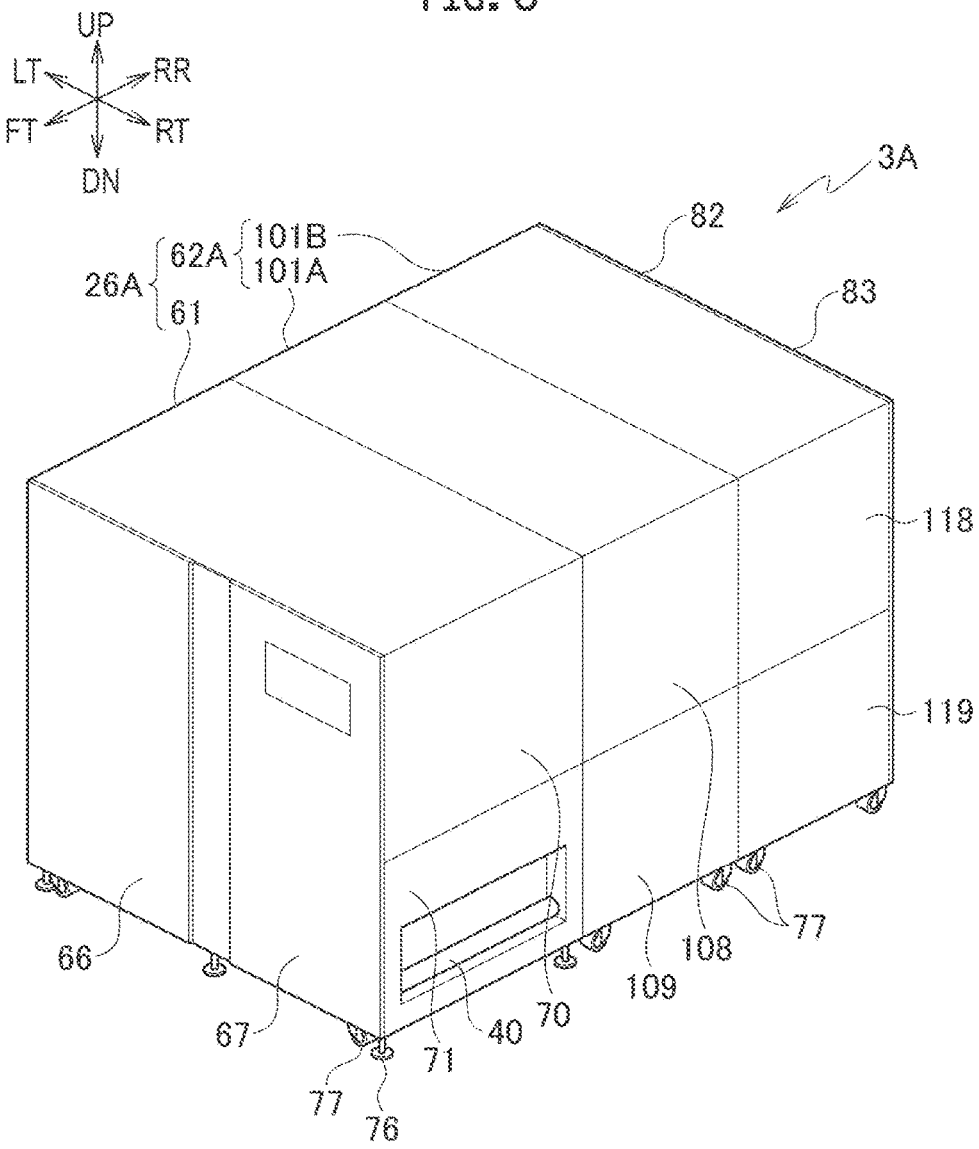
FIG. 6 is a front perspective view of a printing apparatus in a second embodiment.
Figure 7:
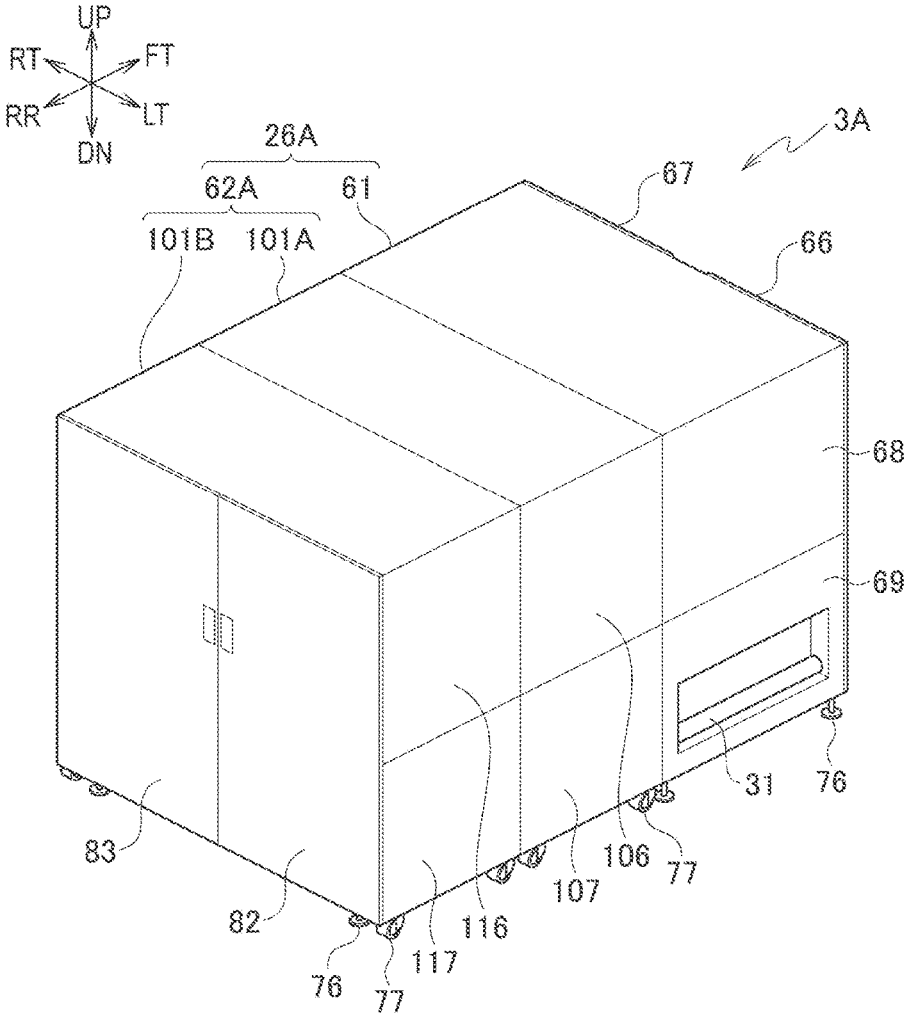
FIG. 7 is a rear perspective view of the printing apparatus illustrated in FIG. 6.
Figure 8:
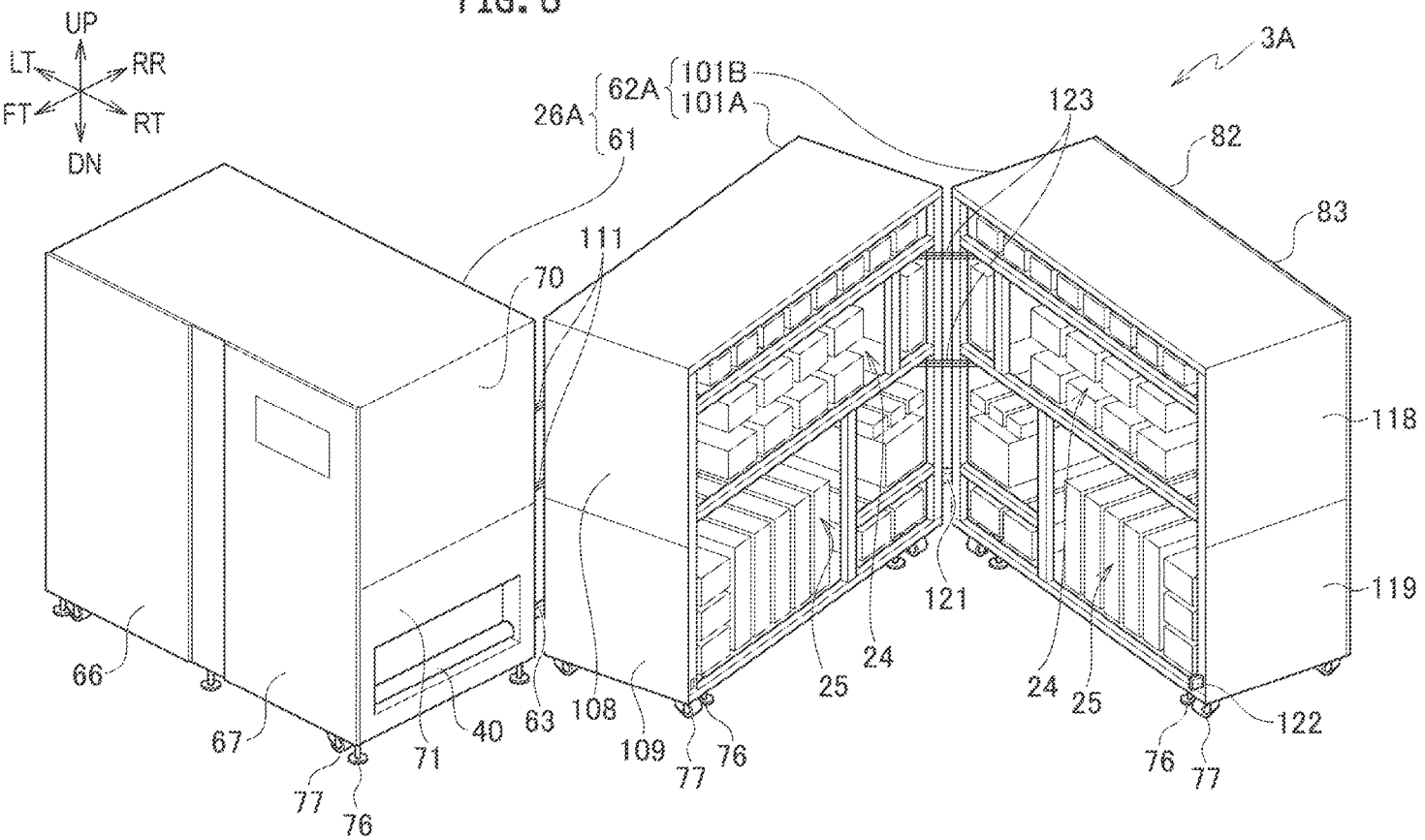
FIG. 8 is a perspective view of a state where an electric component housing of the printing apparatus illustrated in FIG. 6 is opened.

Next, description is given of a second embodiment in which the electric component housing 62 of the printing apparatus 3 in the first embodiment is changed. FIG. 6 is a front perspective view of a printing apparatus 3A in the second embodiment. FIG. 7 is a rear perspective view of the printing apparatus 3A illustrated in FIG. 6. FIG. 8 is a perspective view of a state where an electric component housing 62A of the printing apparatus 3A illustrated in FIG. 6 is opened.

As illustrated in FIGS. 6 to 8, the printing apparatus 3A in the second embodiment has a configuration in which the housing 26 in the first embodiment is replaced with a housing 26A. The housing 26A has a configuration in which the electric component housing 62 in the first embodiment is replaced with the electric component housing 62A.

The electric component housing 62A is divided into two divided housings 101A and 101B. Parts forming an ink circulator 24 and a printing apparatus electric component 25 are distributed and housed in the divided housings 101A and 101B.

The divided housing 101A is formed in a hollow rectangular solid shape with the same height and width as the main body housing 61. The divided housing 101A is arranged between the main body housing 61 and the divided housing 101B, and is connected to the main body housing 61 at a right end by a connector 63. Front and rear sides of the divided housing 101A are open. A left face of the divided housing 101A is formed of side covers 106 and 107 detachably attached. A right face of the divided housing 101A is formed of side covers 108 and 109 detachably attached. Multiple adjusters 76 and casters 77 are attached to a bottom face of the divided housing 101A.

A lock unit (not illustrated) similar to the lock unit 64 in the first embodiment is attached to the divided housing 101A. Moreover, like the wires 91 in the first embodiment, wires 111 between the main body housing 61 and the divided housing 101A are laid along the face on the right side in the left-right direction which is the side where the connector 63 is installed, to extend across the main body housing 61 and the divided housing 101A.

The divided housing 101B is formed in a hollow rectangular solid shape with the same height and width as the main body housing 61. The divided housing 101B is arranged behind the divided housing 101A. A front side of the divided housing 101B is open. A left face of the divided housing 101B is formed of side covers 116 and 117 detachably attached. A right face of the divided housing 101B is formed of side covers 118 and 119 detachably attached. A rear face of the divided housing 101B is formed to be openable and closeable by rear doors 82 and 83. Multiple adjusters 76 and casters 77 are attached to a bottom face of the divided housing 101B.

The divided housing 101B is connected to the divided housing 101A at a left end by a connector (divided housing connector) 121. The connector 121 has a similar configuration to the connector 63 in the first embodiment. Specifically, the connector 121 connects the divided housings 101A and 101B to each other such that the divided housings 101A and 101B are openable and closeable (separable) by moving in the horizontal direction, and allows the divided housings 101A and 101B to open and close while turning about a tilted turning axis, and while moving upward and downward (moving upward and downward relative to each other).

A lock unit 122 similar to the lock unit 64 in the first embodiment is attached to the divided housing 101B. The lock unit 122 locks the divided housings 101A and 101B such that the divided housings 101A and 101B do not open when the divided housings 101A and 101B are closed. Moreover, wires 123 between the divided housings 101A and 101B are laid along the face on the left side in the left-right direction which is the side where the connector 121 is installed, to extend across the divided housing 101A and the divided housing 101B.

As illustrated in FIG. 8, in the printing apparatus 3A, a worker can access the inside of the electric component housing 62A also from the opening portion on the rear side of the divided housing 101A and the opening portion on the front side of the divided housing 101B by opening the divided housings 101A and 101B.

As described above, in the second embodiment, since the electric component housing 62A is divided into the divided housings 101A and 101B and the divided housings 101A and 101B are openable and closeable, the inside of the electric component housing 62A can be more easily accessed. The efficiency of the maintenance work can be thereby further improved.

Moreover, in the printing apparatus 3A, the connector 121 connecting the divided housing 101A and the divided housing 101B has the configuration similar to the connector 63 connecting the main body housing 61 and the electric component housing 62. Accordingly, the divided housings 101A and 101B can be connected to each other such that the divided housings 101A and 101B are allowed to open and close even while turning about the tilted turning axis, and even while moving upward and downward, by using a simple configuration using general parts such as the rod end bearing.

Other Embodiments

Although the aforementioned first and second embodiments are described by using the printing apparatus which performs printing on the web by using an inkjet method, the printing apparatus may be one using a different printing method and a different print medium.

Although the conveyor 21, the first printer 22, and the second printer 23 are housed in the main body housing 61 and the ink circulator 24 and the printing apparatus electric component 25 are housed in the electric component housing 62, 62A in the first and second embodiments, objects to be housed in each housing are not limited to these. Specifically, multiple components of the printing apparatus 3, 3A are not limited to the conveyor 21, the first printer 22, the second printer 23, the ink circulator 24, and the printing apparatus electric component 25, and may further include other components or may not include some of the components described above. Moreover, components to be housed in each housing are not limited to those described in the first and second embodiments. For example, the printing apparatus may be configured such that the first printer 22 and the second printer 23 are housed in the main body housing 61, the printing apparatus electric component 25 is housed in the electric component housing 62, 62A, and the other components are housed in a housing other than the housings described in the first and second embodiments. Furthermore, the components may be arranged to extend across the main body housing 61 and the electric component housing 62, 62A. Moreover, the printing apparatus 3, 3A may include only one of the first printer 22 and the second printer 23.

In the second embodiment described above, there is described the configuration in which the electric component housing 62A is divided into the two divided housings 101A and 101B. However, the configuration may be such that the electric component housing 62A is divided into three or more divided housings and each pair of adjacent divided housings are openably and closably connected by the connector 121.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printing apparatus comprising:

a first component;

a second component;

a first housing configured to house the first component;

a second housing configured to house the second component and movably supported on an installation surface on which the printing apparatus is installed; and a connector configured to connect the second housing openably and closably to the first housing in a horizontal direction and to allow a tilt of a turning axis of the second housing relative to the first housing and an upward and downward movement of the second housing relative to the first housing upon opening and closing of the second housing.

2. Printing apparatus according to claim 1, wherein the first component includes a printer configured to form an image on a print medium, and the second component includes an electric component configured to drive the printer.

3. Printing apparatus according to claim 1, wherein the connector comprises:

a shaft extending in an up-down direction and connected to one of the first housing and the second housing;

a rod end bearing connecting the first housing to the second housing; and a rod end bearing support supporting the rod end bearing and connected to the other of the first housing and the second housing.

4. Printing apparatus according to claim 3, wherein the rod end bearing comprises a housing portion having a spherical surface, a rod portion and a spherical bearing, the housing portion houses and supports the spherical bearing in a movable manner the spherical bearing has a through hole in which the shaft is inserted, the spherical bearing being movable along the shaft, the spherical bearing is slidable on the spherical surface of the housing portion, and the spherical bearing is tiltable relative to the housing portion such that the second housing is openable and closeable relative to the first housing, and the second housing is tiltable about the turning axis to tilt relative to the first housing.

5. The printing apparatus according to claim 1, further comprising:

a first caster configured to support the first housing on the installation surface; and a second caster configured to support the second housing on the installation surface such that the second housing is movable on the installation surface.

6. A printing apparatus comprising:

a first component;

a second component;

a first housing configured to house the first component;

a second housing configured to house the second component and movably supported on an installation surface on which the printing apparatus is installed; and a connector configured to connect the second housing openably and closably to the first housing in a horizontal direction and to allow a tilt of a turning axis of the second housing relative to the first housing and an upward and downward movement of the second housing relative to the first housing upon opening and closing of the second housing, wherein the second housing comprises divided housings, and the printing apparatus further comprises a divided housing connector configured to connect adjacent divided housings of the divided housings to each other openably and closably in the horizontal direction and to allow a tilt of a turning axis between the adjacent divided housings and a relative upward and downward movement between the adjacent divided housings upon opening and closing of the adjacent divided housings.

7. The printing apparatus according to claim 6, wherein the connector comprises:

a first shaft extending in an up-down direction and connected to one of the first housing and the second housing; and a first rod end bearing connected to the other of the first housing and the second housing, the divided housing connector comprises:

a second shaft extending in the up-down direction and connected to one of the adjacent divided housings; and a second rod end bearing connected to the other of the adjacent divided housings, the first rod end bearing comprises a first spherical bearing having a first through hole in which the first shaft is inserted, the first spherical bearing being movable along the first shaft, and the second rod bearing comprises a second spherical bearing having a second through hole in which the second shaft is inserted, the second spherical bearing being movable along the second shaft.

8. Printing apparatus according to claim 7, wherein the first component includes a printer configured to form an image on a print medium, and the second component includes an electric component configured to drive the printer.

9. Printing apparatus according to claim 6, wherein the first component includes a printer configured to form an image on a print medium, and the second component includes an electric component configured to drive the printer.

10. The printing apparatus according to claim 6, further comprising:

a first caster configured to support the first housing on the installation surface; and a second caster configured to support the second housing on the installation surface such that the second housing is movable on the installation surface.

* * * * *